367-94 SR
3/3/81 OR 4,254,483

United States Patent [19]

Vidovic

[11] 4,254,483

[45] Mar. 3, 1981

[54] ULTRASONIC INTRUSION ALARM SYSTEM

[75] Inventor: Nikola Vidovic, Santa Clara, Calif.

[73] Assignee: Atronic Corporation, Santa Clara, Calif.

[21] Appl. No.: 873,253

[22] Filed: Jan. 30, 1978

[51] Int. Cl.[3] ..... G08B 13/16

[52] U.S. Cl. ..... 367/94; 340/507; 340/508

[58] Field of Search ..... 340/560, 508, 507, 609, 340/554, 533, 652; 331/49; 307/355; 367/94, 112

[56] References Cited

U.S. PATENT DOCUMENTS

| | | | |
|---|---|---|---|
| 2,270,771 | 1/1942 | Schonfeld | 331/49 |
| 2,794,974 | 6/1957 | Bagno et al. | 340/560 |
| 3,846,778 | 11/1974 | Galvin et al. | 340/554 |
| 3,925,773 | 12/1975 | Green | 340/560 |
| 3,932,858 | 1/1976 | Smith et al. | 340/693 |
| 3,932,870 | 1/1976 | Shapiro et al. | 340/560 |
| 3,947,834 | 3/1976 | Gershberg et al. | 340/554 |
| 3,967,283 | 6/1976 | Clark et al. | 340/554 |
| 3,976,952 | 8/1976 | Shaver | 307/355 |
| 4,032,916 | 6/1977 | Galvin et al. | 340/508 |

*Primary Examiner*—Glen R. Swann, III
*Attorney, Agent, or Firm*—Claude A. S. Hamrick

[57] ABSTRACT

A number of remotely mountable transmitting heads each has a transducer driven by a sweep frequency ultrasonic signal for generating an ultrasonic field. A number of remotely mountable receiving heads each processes incident doppler shifted energy reflected by a disturbance by developing therefrom a constant amplitude received signal and multiplying this signal by the ultrasonic signal to generate a pair of noise cancelling differential signals. A processor for generates the ultrasonic signal and further processes the received signals so as to detect the disturbance or system tampering.

8 Claims, 2 Drawing Figures

+Vs
+2Vs
12
150
152
168
172
18
20
88
90
170
174
118
220
222
224
226
228
230
232
234
300
302
304
306
308
310
312
314
316
318
320
322
323
324
326
328
330
332
334
336
338
340
342
344
346
348
350
352
354
356
358
360
374
376
378
380
382
384
390
392
396
398
400
402
404
420
422
424
426
428
430
432
434
436
438
450
452
454
456
458
460
462
464

ULTRASONIC INTRUSION ALARM SYSTEM

BACKGROUND OF THE INVENTION

1. Field of the Invention

The present invention relates to burglar detection devices in general and to ultrasonic intrusion alarms in particular.

2. Description of the Prior Art

Ultrasonic intrusion alarm systems and their attendant problems are well known in the prior art. One of the major difficulties associated therewith is how to achieve a system sensitivity adequate to protect more than the smallest space without incurring an unacceptable number of false alarms. Typically, as the system sensitivity is increased to extend the coverage, the system becomes increasingly vulnearable to extraneous signals such as those caused by air turbulence, sonic type background noise and electrical interference from power lines.

Even when an optimum sensitivity setting is obtained, changes in the environment such as the repositioning of furniture or humidity changes can radically effect the overall system sensitivity.

The inclusion of automatic gain control circuitry, at least where constant transmitted frequency signals are employed, may actually aggravate the problem. This is because a slight change in the position of the furniture, for instance, might cause the multiplicity of reflected signals comprising the received signal which might have formally arrived at the receiver in phase to add, to arrive out of phase to cancel. This of course, may cause wild fluctuation in the system sensitivity set by the automatic gain control circuitry.

Typical of the prior art, ultrasonic intrusion alarm systems which address the noise problem are two U.S. Pat. Nos. 3,781,859 and 3,721,972, both issued to Albert L. Hermans. The former patent also illustrates the use of special purpose filters for removing electrical power, radio and lightning caused interference as well as special circuitry for minimizing false alarms caused by air turbulence.

The latter patent illustrates the use of traditional ultrasonic transmitters and receivers externally mounted around an enclosed space which is to be protected from intrusion. In addition, one receiver is mounted inside the enclosed space so as to be substantially isolated from the transmitters by the walls enclosing the space.

This novel feature detects entry into the space by detecting the opening of a door or a window which completes a sonic path actuating the alarm.

This patent further recognizes another problem associated with ultrasonic intrusion alarms, namely, that when a multiplicity of remotely mounted transmitters and/or receivers are employed to increase the coverage of the system or to protect remote locations, the system becomes increasingly susceptible to tampering.

SUMMARY OF THE PRESENT INVENTION

It is therefore an object of the present invention to provide an ultrasonic intrusion alarm system having an improved detection sensitivity and a decreased likelihood of false alarms.

Another object of the present invention is to provide an ultrasonic intrusion alarm system having improved tampering resistance.

Briefly, the preferred embodiment of the present invention includes at least one remotely mountable transmitting head, at least one remotely mountable receiving head and a processor connected to the receiving and transmitting heads by a five-wire cable.

Each of the transmitting heads has an ultrasonic energy field generating transducer driven by a sweep frequency ultrasonic signal obtained from a transmit wire of the cable.

Each of the receiving heads has a transducer for receiving reflected field energy and doppler shifted energy reflected by a disturbance within the field, an AGC amplifier system for developing a constant amplitude received signal, a multiplier for generating a pair of noise cancelling differential signals between a pair of receive wires of the cable, the differential signals being proportional to the product of the constant amplitude received signal and the ultrasonic signal, a tamper detector for, in the absence of a received signal or when the receiving head cover is removed, developing a tampering detected signal on a tampering wire of the cable, and a power supply for developing a receiving head powering potential from a DC potential and from the ultrasonic signal imposed thereon.

The receiving or transmitting head at the end of the cable distal the processor also has a resistor terminating the tampering wire permitting the processor to detect if the cable has been cut.

The processor has transmitting head driving circuitry for generating the ultrasonic signal and imposing the DC potential thereon, receiving circuitry for further processing the differential received signals initially processed by the receiving heads to detect the disturbance and for actuating an annunciator and circuitry monitoring the tampering wire for detecting tampering with the system and for detecting if the cable has been cut.

A principle advantage of the present invention is that it can monitor a large space using a minimum number of easily installed, tamper resistant, remote transmitting and receiving heads.

These and other objects and advantages of the present invention will no doubt become apparent to those skilled in the art after having read the following detailed description of the preferred embodiment which is illustrated in the several figures of the drawing.

IN THE DRAWING

FIG. 1 is a block diagram generally illustrating the principle components of an ultrasonic intrusion alarm system in accordance with the present invention; and FIG. 2 is a schematic diagram further illustrating the components comprising one of the receiving heads and a portion of the associated processing unit components shown in FIG. 1.

DETAILED DESCRIPTION OF THE PREFERRED EMBODIMENT

Figure 1:
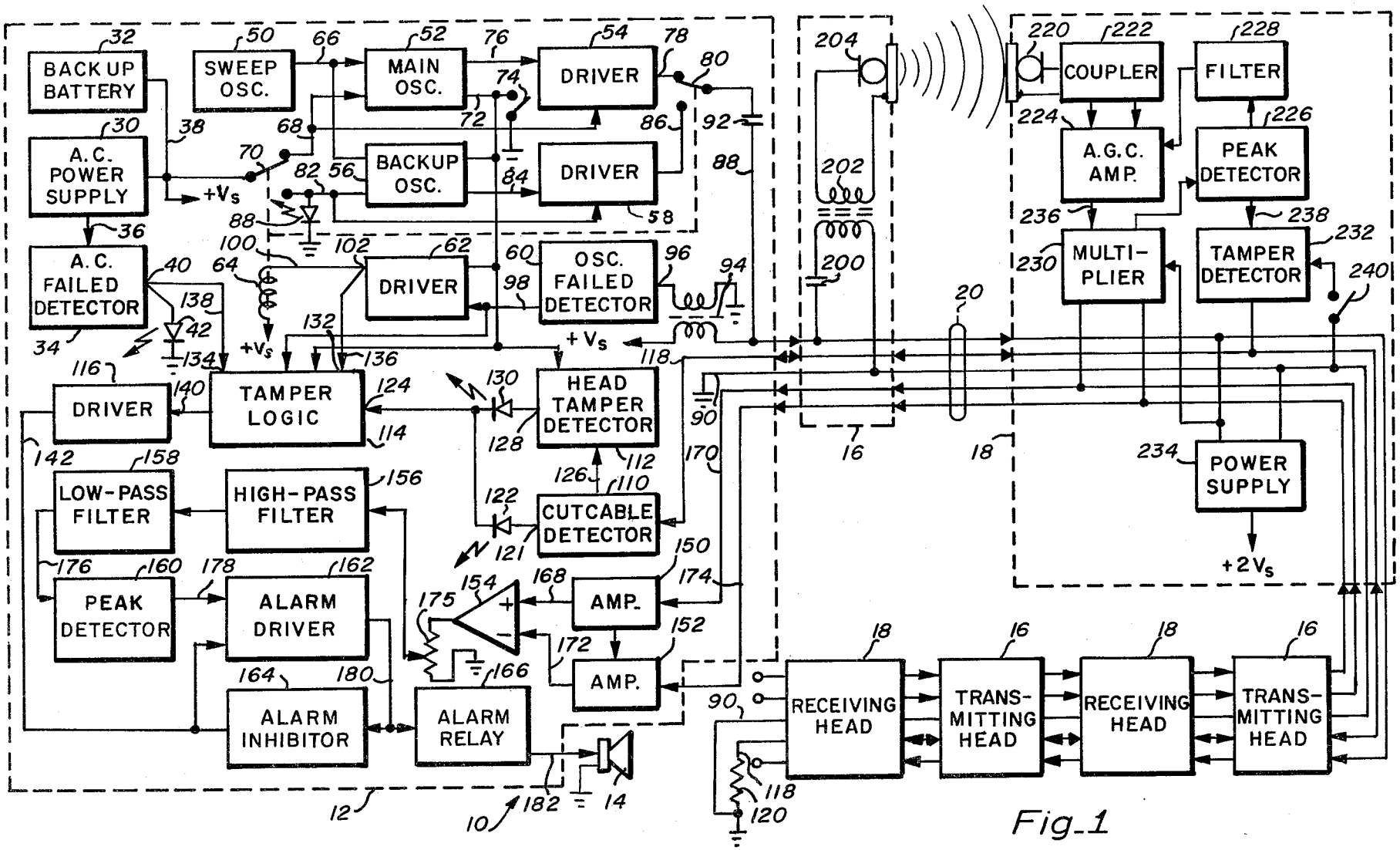

Referring to FIG. 1 of the drawing, the principle components of a preferred embodiment of an ultrasonic intrusion alarm system in accordance with the present invention is generally designated by the number 10. The system is shown to include a processor 12, for generating a sweep frequency ultrasonic signal, an annunciator 14, a plurality of remotely mountable transmitting heads 16 driven by the ultrasonic signal for generating an ultrasonic energy field, a plurality of remotely mountable receiving heads 18 for receiving and initially processing doppler shifted energy reflected by a disturbance in the field and for detecting certain types of tampering with the system and a cable 20 connecting the processor to the transmitting and the receiving heads. The processor also further processes signals for the receiving heads to actuate the annunciator in response to the disturbance or the tampering.

System power is primarily derived from the AC power line potential by an AC power supply 30 and secondarily from a backup battery 32. The power line potential and operation of the AC power supply is monitored by an AC failed detector 34. AC power supply 30 is in the preferred embodiment, of a conventional design including a transformer for developing a 17 volt AC potential from the power line potential, a bridge rectifier for rectifying the potential and a filter capacitor for developing an unregulated DC potential on a line 36. This DC potential is coupled by an isolation diode to an integrated circuit voltage regulator which develops a regulated DC output potential of 13.7 volts on a line 38 which is also connected to backup battery 32. The regulated DC potential from the power supply or alternatively from the backup battery is routed to various circuits of the processor in conventional fashion except as specifically noted.

AC failed detector 34 includes circuitry for monitoring the unregulated DC potential developed on line 36 by the power supply. Responsive to a drop in this potential, such as might be caused by a power failure, the detector is operative to develop a light emitting diode (LED) operating potential at a terminal 40 and thus to an LED indicator 42 connected from there to circuit ground which provides visual indication of the AC power loss.

Another portion of the processor circuitry dedicated to developing a sweep frequency ultrasonic signal for driving the transmitting heads includes a sweep oscillator 50, a main oscillator 52, a first driver 54, a backup oscillator 56, a second driver 58, an oscillator failed detector 60, a relay driver 62 and a relay 64.

Sweep oscillator 50 utilizes a conventional integrated circuit timing device connected in an oscillator configuration to develop a sweep signal on a line 66. In the preferred embodiment the sweep signal is comprised of substantially time symmetrical saw tooth or triangular pulses, having a frequency of approximately $\frac{1}{2}$ to $\frac{1}{3}$ hertz. Normally, the sweep frequency ultrasonic signal is developed by main oscillator 52. This oscillator selectively receives operating power at an input which is connected by a line 68 and a normally closed contact of a set of contacts 70 of relay 64 to the power supply line 38. Oscillator 52 also has a frequency controlling input connected to line 66, an oscillator disable input connected by a line 72 and an oscillator disable switch 74 to circuit ground, and an output connected to a line 76.

When switch 74 is open and line 68 is connected to line 38 by relay 64, main oscillator 52 is operative to generate an ultrasonic frequency signal on line 76 having a frequency which is modulated by the level of the signal generated by sweep oscillator 50 on line 66. In the preferred embodiment an integrated circuit timing device is used to generate an ultrasonic saw tooth signal having a center frequency of 22.3 khz and a deviation of $\pm 15$ hz, as controlled by the sweep signal.

The ultrasonic frequency signal generated by oscillator 52 is amplified to a suitable level for driving the transmitting heads by driver 54 which also isolates the oscillator from the heads. Driver 54 has an input connected to line 68 for selectively receiving operating power, a signal input connected to line 76 for receiving the ultrasonic signal and for developing an amplified ultrasonic signal on a line 78 which is connected to the normally closed contact of another set of contacts 80 of relay 64. Driver 54, in the preferred embodiment, is comprised of four transistors connected in a common emitter complimentary symmetry amplifier configuration.

Backup oscillator 56, which is similar to oscillator 52, has an input for selectively receiving operating power connected by a line 82 to the normally open contact of contacts 70, an input for receiving the sweep signal connected to line 66, a disable input connected to line 72 and an oscillator output connected to a line 84. Driver 58, which is similar to driver 54, has an input connected to line 82 for selectively receiving operating power, a signal input connected to the output of oscillator 56 by line 84 and an output for developing an amplified output signal on a line 86 which is connected to the normally open contact of relay contacts 80.

When switch 74 is open and oscillator 52 or driver 54 have failed causing the closure of relay 64, oscillator 56 and driver 58 are operative to generate the amplified ultrasonic signal on line 86 which was formerly generated by oscillator 52 and driver 54 on line 78. An LED 88 is connected between line 82 and circuit ground to provide visual indication that backup oscillator 56 and driver 58 are being powered.

From the ultrasonic signal selectively developed on lines 78 or 86 a DC off-set ultrasonic signal is developed between a wire 88 and a ground return wire 90 of cable 20 for routing to the heads. More specifically a DC blocking capacitor 92 which is connected to relay contacts 80 couples the AC component of the ultrasonic signal to wire 90. This component is offset by the DC power supply potential by means of a transformer 94, the primary of which is connected between wire 90 and the positive power supply so as to operate as a choke. The transformer is further operative to couple the ultrasonic signal to the input of the oscillator failed detector 60 which is connected by a line 96 and the secondary of the transformer to circuit ground.

Oscillator failed detector 60 and driver 62 monitor the ultrasonic signal and upon detection of the failure of either main oscillator 52 or driver 54 actuate relay 64 to transfer power to backup oscillator 56 and driver 58. More specifically, detector 60 includes a common emitter transistor amplifier connected between line 96 and an output line 98 for developing a high or a low signal level on line 98 in response to the absence or presence, respectively, of an ultrasonic signal on line 96.

Driver 62 includes a resistor-capacitor time constant circuit connected between line 98 and circuit ground. The capacitor is connected to a common collector transistor amplifier which drives a common emitter transistor amplifier having a collector connected to a terminal 102 and to the power supply by a line 100 and relay 64. The capacitor is further connected to line 84 by an isolating diode and the base of the common emitter amplifier is connected to line 82 by a resistor.

A high signal level developed on line 98, in the absence of an ultrasonic signal, charges the capacitor causing conduction of the transistors and thus the actuation of the relay. Actuation of the relay transfers the power supply potential to line 82 actuating backup oscillator 56 and maintaining conduction of the common emitter amplifier and thus the relay.

Closure of disable switch 74, which turns off the ultrasonic oscillators and drivers, prevents the charging of the RC circuit which, upon the opening of the switch, provides a delay that allows oscillator 52 time to generate the ultrasonic signal before the actuation of relay 64 occurs.

Another portion of the processor which may be generally characterized as dedicated to system tampering detection and system failure detection includes a cut cable detector 110, a head tamper detector 112, a tamper logic 114 and a driver 116.

Cut cable detector 110 includes a biasing resistor connected between the power supply and a tamper wire 118 of cable 20. This resistor cooperates with a second biasing resistor 120, which is connected between wires 118 and 90 at the distal end of the cable, to develop a bias potential on wire 118. Additional circuitry in the detector monitors this bias potential and responsive to an increase in the potential such as would occur if either wire 90 or 118 were cut, develops an LED driving signal at an output terminal 121. An LED 122 connected between terminal 121 and an input terminal 124 of tamper logic 114 provides visual indication of this condition.

Each receiving head 18 includes circuitry discussed in detal below, which in response to either a loss of the received ultrasonic field signal or indication of tampering with the head, shorts the bias potential developed on wire 118 to ground (wire 90). Circuitry in cut cable detector 110 is further responsive to such a drop in the bias potential and operative to develop a tamper detector driving signal on an output connected to detector 112 by a line 126.

Tamper detector 112 includes circuitry connected to lines 126 and 72 which, when disable switch 74 is open, responds to the head tamper signal developed on line 126 and generates an LED driving signal at an output terminal 128. An LED 130 which is connected between terminal 128 and terminal 124 of the tamper logic provides visual indication of the tampering.

Tampering logic 114 includes inputs connected to diodes 122 and 130 for receiving the cut cable and head tamper signals, to line 72 for receiving the disable signal, to line 98 for receiving the oscillator fail detected signal and auxiliary inputs connected to two terminals 132 and 134. These auxiliary terminals may optionally be connected to terminals 102 and 40 as illustrated by two lines 136 and 138.

Tamper logic 114 includes a common emitter transistor amplifier and diodes for developing a driver actuating signal on an output line 140 in response to a tamper signal developed at terminal 124, a main oscillator failed signal developed at terminal 132, an AC power supply failed signal developed at terminal 134 and when switch 74 is open, an oscillator failed signal developed on line 98.

Driver 116 includes two common emitter transistor amplifier stages for receiving the signal developed by tamper logic 114 on line 140 and for generating an amplified signal on an output line 142.

Disturbance signals developed by heads 18 are further processed by a portion of the processor which includes three amplifiers 150, 152 and 154, a high pass filter 156, a low pass filter 158, a peak detector 160, an alarm driver 162, an alarm inhibitor 164 and an alarm relay 166. Amplifier 154 has a non-inverting input connected to a wire 170 of cable 20 by a line 168 and amplifier 150, an inverting input connected to a wire 174 of cable 20 by a line 172 and amplifier 152 and an output connected to circuit ground by a potentiometer 175 the wiper of which is connected to filter 156. Amplifier 154 is operative to generate a signal across potentiometer 175 which is proportional to the amplified difference between the differential signals generated on wires 170 and 174 by the receiving heads.

Two-stage four-pole, high-pass filter 156 and single-stage two-pole, low-pass filter 158, which are conventional integrated circuit active filters, filter the difference signal developed at the wiper of potentiometer 175 to pass those signal components between the 30 and 80 hertz cut off frequencies of the filters, which correspond to the predominant components of doppler shifted energy reflected by a human intruder.

The peak detector includes a capacitor and a diode connected in series between a line 176 connected to the output of low-pass filter 158 and circuit ground to generate a clamped or DC restored signal across the diode proportional to the total energy in the doppler signal developed on line 176. By utilizing the total energy in the doppler signal, uniform sensitivity is maintained which might otherwise change radically as a result of the nonsymmetrical doppler waveform. This clamped signal is amplified in an emitter follower for coupling to alarm driver 162 by a line 178.

Alarm driver 162 includes a resistor connected between line 178 and line 142 and a capacitor connected between line 142 and circuit ground forming an RC time delay or low pass filter circuit having approximately one second time delay for signals developed on line 178 and negligible delay for signals developed on line 142. These signals are amplified and further delayed in a three stage transistor amplifier which includes a common collector stage, a common emitter stage and another common collector stage to develop a relay driving signal on a line 180.

Alarm inhibit 164, which is connected between lines 180 and 142, includes an integrated circuit timer device configured to discharge the capacitor in alarm driver 162 in response to the first alarm signal which is received within a four second period. In other words, two signals must be generated on line 178 within a four second period in order to actuate alarm relay 166.

As illustrated, alarm relay 166 is connected by a line 182 to annunciator 14 providing aural warning of the field disturbance or of system tampering. It is anticipated however, that line 182 may alternatively be connected to a multiplexer to combine signals of this processor with those of other similar processors to be coupled to a remote monitoring location.

Transmitting head 16 includes a capacitor 200, a transformer 202 and an ultrasonic transducer 204. Capacitor 200 couples the AC component of the sweep frequency ultrasonic signal generated between wires 88 and 90 to the primary of transformer 202. The energy is coupled by the transformer to transducer 204 which generates an ultrasonic field in the proximity of the transducer.

Receiver 18 includes a transducer 220, a coupler 222 an AGC amplifier 224, a peak detector 226, a filter 228, a multiplier 230, a tamper detector 232 and a power supply 234. Transducer 220 converts the reflected ultrasonic field energy including doppler shifted energy reflected by a disturbance in the field in to an electrical signal which is coupled by coupler 222 to AGC amplifier 224.

AGC amplifier 224, peak detector 226 and filter 228 form an AGC system which develops a constant level received signal for input to the multiplier on a line 236.

In the absence of a received signal, peak detector 226 further generates a signal indicative of tampering on a line 238.

Multiplier 230 develops differential signals on wires 170 and 174 proportional to the product of the constant level received signal and the ultrasonic signal developed on wire 88 for further processing by the processor. Tamper detector 232 responsive to either the signal developed on line 238 or the closure of a tamper switch 240 which is actuated when the receiver head cover is removed, is operative to short the potential developed on wire 118 to wire 90.

Power supply 234 derives operating power for the receiving head from the ultrasonic signal and the offsetting potential developed between wires 88 and 90.

Operationally, power for system operation is primarily derived from the AC power line by AC power supply 30 and during a power failure, power is obtained from backup battery 32. A power failure causes LED 42 to light to alert an operator. Operation notification is important since he might not otherwise be aware if, for example, a power cord were kicked from the wall. Normally, actuation of the annunciator is not necessary because the backup battery can support the system for approximately 24 hours.

When disturbance detection is not required, switch 74 is closed and the system only monitors for tampering. Usually, when switch 74 is open, main oscillator 52 and driver 54 are powered to generate an ultrasonic frequency signal on wire 88 having a frequency which is varied in proportion to the sweep signal generated by sweep oscillator 50. This signal is combined with the DC power supply potential capacitor 92 and transformer 94 for distribution to the various transmitting and receiving heads.

Should main oscillator 52 or driver 54 fail, the resultant loss of the ultrasonic signal will be detected by oscillator fail detector 60 which, with driver 62, causes the actuation of relay 64 transferring power to backup oscillator 56 and driver 58. Since no loss of detection capability results from the changeover, the display of the condition as provided by LED 88 is usually sufficient. Alternatively, line 136 may be used to couple the signal to logic 114 and thus to cause actuation of the annunciator.

The ultrasonic frequency signal is coupled by wires 88 and 90 to each of the transmitting heads 16 where capacitor 200 and transformer 202 couple the AC component of its signal to transducer 204 which develops an ultrasonic energy field.

Reflected field energy as well as any doppler shifted energy reflected by a disturbance within the field is converted to an electrical signal by transducer 220 of the respective receiving head 18.

The received signal is coupled by coupler 222 and amplified by AGC amplifier 224 to develop a constant level received signal for driving one input of multiplier 230. Peak detector 226 and filter 228 provide the feedback for controlling the amplifier gain and in the absence of a received signal, provide a tampering indicative signal to drive the tamper detector 232.

It should be noted that the AGC system (amplifier 224, detector 226 and filter 228) absent the cooperation of sweep oscillator 50 would degrade rather than improve system performance. More specifically, without the AGC system changes in the system sensitivity would, for example, occur due to changes in the relative humidity which effects the transmission efficiency and thus the loss experienced by all signals.

Apparent changes in sensitivity will also occur dependent upon the phase relation of the various reflected signals comprising the received signal. For example, on one day a signal reflected from a wall and another reflected from a chair might arrive at the receiver in phase to add. Another day, due to a slight shift in the position of the chair or of the transmitter frequency, the two signals might arrive out of phase to cancel. Thus, in a constant frequency system, the amplitude of the received signal is an unreliable indicator of system sensitivity.

By sweeping the oscillator frequency and thus changing the wavelength, the received signals add in many various ways cancelling at some oscillator frequencies and adding at others to develop an overall signal which is a reliable indicator of system sensitivity.

The ultrasonic signal generated by the processor is also coupled to the second input of the multiplier which multiplies it by the constant level received signal to generate a pair of differential difference frequencies on wires 170 and 174. The received and ultrasonic, or reference, signals are multiplied together as opposed to the conventional additive process.

This results in a considerable signal to noise level improvement particularly where either the reference signal level or the noise level is greater than that of the received signal.

After being amplified by amplifiers 150 and 152 the differential signals are combined in amplifier 154 such that they add but any noise signals developed on wires 170 and 174 cancel.

The combined signals are filtered in filters 156 and 158 which pass only those components most indicative of a human intruder caused disturbance within the ultrasonic field.

After being detected by peak detector 160, the doppler signal components are coupled to alarm driver 162 which, with alarm inhibit 164, discriminates between random single occurence signals and persistant doppler signals. The later signals are amplified to drive alarm relay 166 to operate either annunciator 14 or a remotely located alarm device.

Receiving heads 18 also include a tamper detector 232 and a power supply 234. The tamper detector is responsive to either the signal generated on line 238 when no ultrasonic field energy is being received or to the closure of switch 240 which occurs when the receiving head cover is removed, and is operative to short wire 118 to wire 90. The power supply extracts receiving head operating power from the ultrasonic signal generated between lines 88 and 90.

Cut cable detector 110 in conjunction with resistor 120 establishes a bias potential on wire 118. Should this potential increase as would occur if cable 20 where cut, cut cable detector 110 will develop a signal causing operation of LED 122 to provide visual indication of this event.

Cut cable detector 110 and tamper detector 112 also develop a signal for operating LED 130 whenever the bias potential drops, which would indicate a tampering with the receiving head or a loss of the received ultrasonic energy signal.

Logic 114 is responsive to either of these LED operating signals and optionally the loss of AC power or the main oscillator or driver and operative with driver 116 to generate a signal causing immediate actuation of alarm driver 162 and thus annunciator 14.

Figure 2:
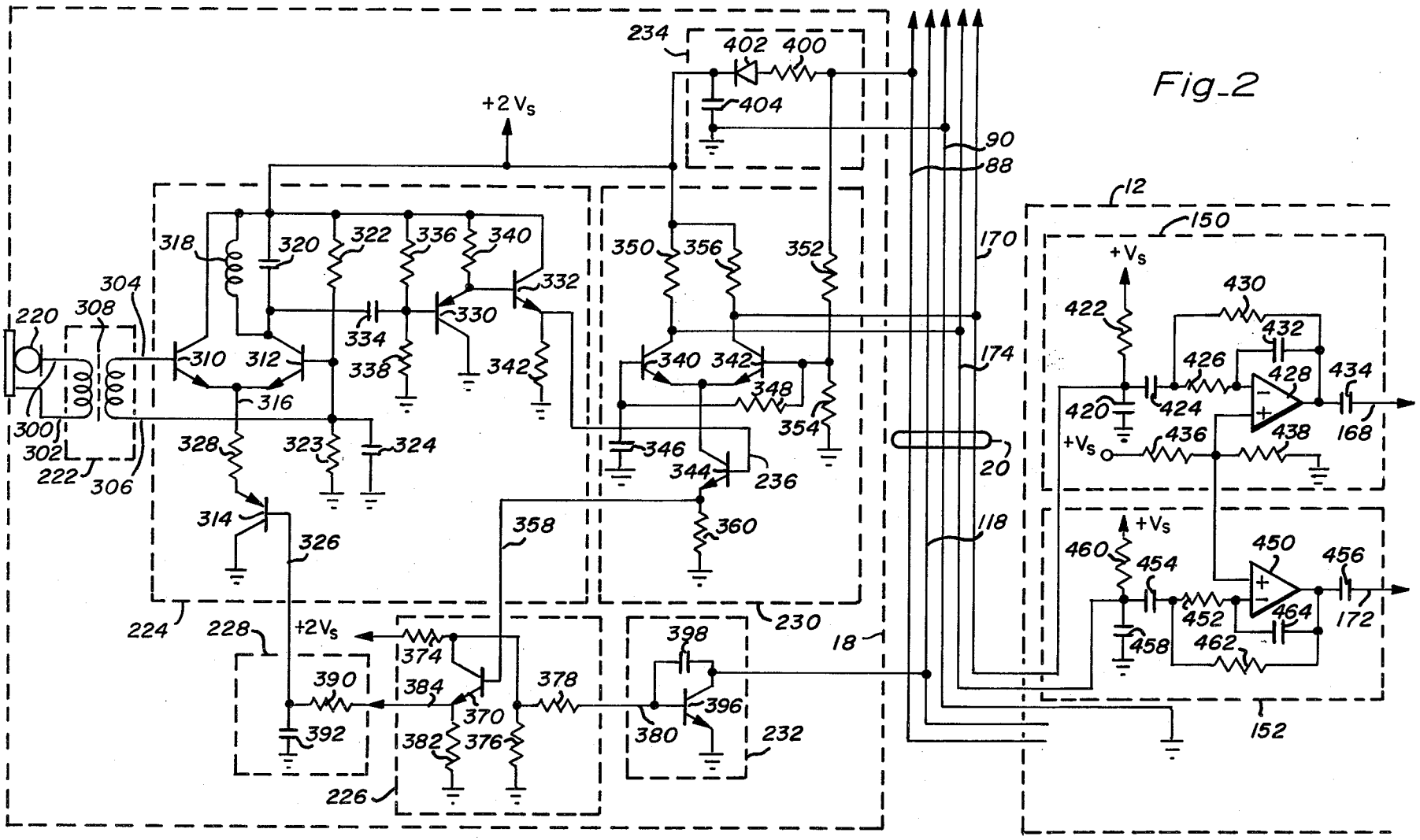

Turning now to FIG. 2 a schematic diagram further illustrating the components of receiving head 18 and amplifiers 150 and 152 is shown. As indicated the receiving head includes a transducer 220 for converting ultrasonic signals incident thereon into electrical impulses on a pair of lines 300 and 302 which are coupled to AGC amplifier 224 by coupler 222 and a pair of lines 304 and 306. In the preferred embodiment a transformer 308 of suitable turns ratio for matching the impedance of the transducer to the input impedance of the AGC amplifier is used for the coupler.

AGC amplifier 224 is comprised of a differential amplifier and a Darlington amplifier. The differential amplifier includes 2 NPN transistors 310, 312 and a PNP transistor 314. Transistor 310 has a base which is connected to line 304, a collector which is connected to the receiving head power supply and an emitter which is connected by a line 316 to the emitter of transistor 312.

Transistor 312 also has a collector which is connected to the receiving head power supply by both an inductor 318 and a capacitor 320 which form a tuned circuit and a base which is connected to line 306. The bases of transistor 310 and 312 are biased by a potential developed by a voltage divider which includes a biasing resistor 322 connected from line 306 to the power supply, another bias resistor 323 connected between line 306 and circuit ground and a bypass capacitor 324 connected across resistor 323.

Transistor 314 also has a base which is connected to filter 228 by a line 326, an emitter which is connected by a resistor 328 to line 316 and a collector which is connected to circuit ground.

The Darlington amplifier includes a PNP transducer 330 and an NPN transistor 332 connected in a complimentary Darlington configuration. In other words, the base of transistor 330 is connected by a DC blocking capacitor 334 to the collector of transistor 312, by a biasing resistor 336 to the power supply and by another biasing resistor 338 to circuit ground. The collector of transistor 330 is grounded, and its emitter is connected to the base of transistor 332 and through a resistor 340 to the power supply.

Transistor 332 also has a collector which is connected to the power supply and an emitter which is connected to circuit ground by a resistor 342 and to multiplier 230 by line 236.

Transistors 310 and 312 are responsive to the signal developed on line 304 with respect to line 306 to develop at the collector of transistor 312 an amplified representation of that portion of the signal which is within the passband of the filter comprised of inductor 318 and capacitor 320.

The amplifier gain is controlled by transistor 314 which sinks at its emitter a current that is inversely proportional to the voltage developed on line 326. Since the gain of transistors 310 and 312 is proportional to this current, the gain of the differential amplifier is proportional to the voltage developed on line 326.

Transistors 330 and 332 are operative to amplify the signal developed at the collector of transistor 312 to develop a current amplified signal on line 236.

Multiplier 230 is also comprised of a differential amplifier which includes 3 NPN transistors 340, 342 and 344. The base of transistor 340 is connected to a bias network comprised of an AC bypass capacitor 346 connected from the base to ground and a biasing resistor connected between the bases of transistors 340 and 342. Transistor 340 also has a collector which is connected to wire 170 and to the power supply by a load resistor 350 and an emitter which with the emitter of transistor 342 is connected to the collector of transistor 344.

The base of transistor 342 is also connected to a voltage divider formed by a resistor 352 connected from the base to wire 88 and a resistor 354 connected from the base to ground. The collector of transistor 342 is connected to wire 174 and by a load resistor 356 to the positive power supply potential.

Transistor 344 also has a base which is connected to line 236 and an emitter which is connected both to a line 358 and to circuit ground by a resistor 360.

The amplified received ultrasonic frequency signal developed at the base of transistor 344 by AGC amplifier 224 controls the current which the transistor sinks and thus the gain of the differential amplifier (the gain being inversely proportional to the instantaneous amplitude of this signal).

The voltage divider comprised of resistor 352 and resistor 354 reduces the magnitude of the sweep frequency ultrasonic signal and DC component developed on wire 88 to both bias transistors 340 and 342 and to develop an ultrasonic signal of suitable amplitude for driving transistor 342. In the preferred embodiment an AC signal level of approximately 600 millivolts is developed at the base of transistor 342. The instantaneous level of this signal also controls the gain of transistors 340 and 342.

Thus, since the amplified signal is proportional (or inversely proportional) to the instantaneous amplitude of the two signals, the output of the differential amplifier is proportional to the product of the two signals. The differential amplifier generates a pair of equal amplitude signals at the difference frequency on wires 170 and 174 which are 180° out of phase, or differential signals.

Transistor 344 is also operative to further current amplify the received ultrasonic frequency signal developed by the AGC amplifier for coupling to peak detector 226.

Peak detector 226 includes an NPN transistor 370 having a base connected to the emitter of transistor 344, a collector which is connected to the power supply by a resistor 374, to circuit ground by a resistor 376, and to tamper detector 232 by a resistor 378 and a line 380. The transistor also has an emitter which is connected to ground by a resistor 382 and to filter 228 by a line 384.

Peak detector 226 is responsive to the ultrasonic signal level developed on line 236 and operative to generate a DC biasing signal on line 384 proportional to the amplitude of this signal. In the absence of a receive signal, resistor 374 develops a high signal level on line 380 of amplitude sufficient to actuate tamper detector 232.

Filter 228 is comprised of an RC filter including a resistor 390 connected between lines 334 and 326 and a capacitor 392 connected from line 326 to ground. The time constant of the filter is chosen to be greater than the sweep frequency of the sweep frequency ultrasonic signal and also sufficiently long to insure stability of the AGC loop.

Tamper detector 232 is comprised of an NPN transistor 396 and a Miller capacitor 398. The transistor has a base which is connected to line 380 and to its collector by a capacitor 398, an emitter which is connected to ground and a collector which is also connected to wire 118. Responsive to a persistent high signal level developed on line 380 developed in the absence of a received ultrasonic signal, transistor 396 conducts shorting wire 118 to wire 90 to indicate system tampering.

Power supply 234 includes the series connection of a current limiting resistor 400, a rectifying diode 402 and a filter capacitor 404 connected between wire 88 and ground (wire 90). Since the potential developed on wire 88 is the sum of the processor DC power supply voltage and the AC sweep frequency ultrasonic signal, the capacitor is operative to charge to the peak level of this signal to develop a receiving head power supply voltage of just under twice the processor power supply voltage.

Since amplifiers 150 and 152 of processor 12 interact with the multipliers of the various receiving heads they are also represented in schematic form in FIG. 2. Amplifier 150 includes a filter capacitor 420 connected from wire 170 to circuit ground for removing low frequency signals and noise from the signal developed on wire 170, a pull-up resistor 422 connected between wire 170 and the power supply potential for cooperating with resistor 356 in biasing transistor 342 and similar transistors in the other receiving heads, and a DC blocking capacitor 424 and an oscillation suppression resistor 426 connected from wire 170 to the inverting input of an operational amplifier 428. The amplifier also includes a gain determining resistor 430 connected between the juncture of capacitor 424 and resistor 426 and the ouput of the operational amplifier, a band width limiting capacitor 432 connected from the inverting input to the output of the operational amplifier and a DC blocking capacitor 434 connected from the output of the operational amplifier to line 168. The amplifier further includes a voltage divider comprised of resistors 436 and 438 for biasing the non-inverting input of the operational amplifier at a suitable level.

The gain of the operational amplifier is determined in part by the ratio of resistor 430 to the parallel combination of the impedances of resistors 422, 356, and other resistors similarly situated in the other receiving heads. It will be noted that although as the number of receiving heads utilized increases, and thus the number of resistors similar to resistor 356 increase, decreasing the signal amplitude on wire 170, the gain of operational amplifier 428 increases proportionally to compensate.

Amplifier 152 includes an operational amplifier 450 having a non-inverting input connected to the similar input of operational amplifier 428, an inverting input connected by an oscillation suppressing resistor 452 and a DC blocking capacitor 454 to wire 174 and an output connected by a DC blocking capacitor 456 to line 172. A capacitor 458 is connected from wire 174 to circuit ground, and a DC biasing resistor 460 is connected from wire 174 to the power supply. In addition, a gain setting resistor 462 is connected from the juncture of resistor 452 and capacitor 454 to the output of the operational amplifier, and a band width setting capacitor 464 is connected from the inverting input of the operational amplifier to the output of the operational amplifier.

Signals developed on wire 174 are amplified by amplifier 152 to develop on line 172 signals similar to, but 180° out of phase with, those signals developed on line 168. As indicated above, these two singals are subtracted in amplifier 154 (FIG. 1) to cancel noise developed on wires 170 and 174.

It is contemplated that after having read the preceding disclosure certain alternations and modifications of the present invention will no doubt become apparent to those skilled in the art. It is therefore intended that the following claims be interpreted to cover all such alterations and modifications as fall within the true spirit and scope of the invention.

What is claimed is:

1. An ultrasonic intrusion alarm system for detecting a disturbance in an ultrasonic field comprising:

oscillator means including a sweep oscillator for generating a sweep signal and a main oscillator driven by said sweep oscillator and operative to generate an ultrasonic signal, the frequency of which is swept at frequency of said sweep signal;

transmitting means for receiving said ultrasonic signal and for generating an ultrasonic field commensurate therewith;

receiving means disposed proximate said transmitting means for receiving said ultrasonic signal, for receiving Doppler shifted energy reflected by a disturbance in the field and for generating a difference signal at the Doppler frequency of said reflected energy, said receiver means including transducer means for receiving said Doppler shifted energy and for generating a received signal, receiver amplifier means for developing an amplifier received signal, said receiver amplifier means including AGC amplifier means for receiving said received signal and a level signal and for developing said amplified signal, said AGC amplifier having a gain which is controlled by the amplitude of said level signal; and peak detector means for receiving said amplified signal and for developing said level signal commensurate with the amplitude thereof, said amplified received signal being normally maintained at a substantially constant level, said peak detector means further developing a low received level signal when the amplitude of said amplified received signal is less than a predetermined level, a multiplier for receiving said amplified received signal and said ultrasonic signal, and for developing the product of said amplified received signal and said ultrasonic signal to generate said difference signal;

field disturbance detector means for receiving said difference signal and for developing an annunciator driving signal when said difference signal exceeds a predetermined level;

tamper detector means for receiving said low received level signal and for developing a tamper detected signal commensurate therewith;

a cable having a first end connected to said field disturbance detector means and a second end and including a pair of wires, said cable for coupling said difference signal to said field disturbance detector means and for coupling said low received level signal to said tamper detector means; and impedance means connected between said pair of wires at said second end, said tamper detector means further causing a current to flow through said pair of wires to develop said tamper detector signal when a potential is developed between said pair of wires which exceeds a predetermined level; and annunciator means responsive to said annunciator driving signal, said annunciator means also being responsive to said tamper detected signal.

2. An ultrasonic intrusion alarm system as recited in claim 1 wherein said oscillator means further includes:

oscillator fail detector means for receiving the ultrasonic signal and in the absence thereof for generating a change-over signal; and backup oscillator means for receiving said sweep signal and said change-over signal and when said main oscillator means fails for generating said ultrasonic signal.

3. An ultrasonic intrusion alarm system as recited in claim 1 wherein said annunciator means includes:

alarm inhibit means for generating an inhibit signal when said annunciator driving signal does not exceed a predetermined condition;

alarm driver means for receiving said annunciator driving signal and said inhibit signal and for generating an alarm signal when said annunciator driving signal exceeds said predetermined condition; and alarm means responsive to said alarm signal.

4. An ultrasonic intrusion alarm system as recited in claim 3 wherein said predetermined condition is a predetermined time period.

5. An ultrasonic intrusion alarm system as recited in claim 1 further comprising:

a source of DC potential;

capacitor means;

inductor means;

a cable including a wire connected to said transmitting means, connected to said multiplier, connected to said potential source by said inductor means and connected to said oscillator means by said capacitor means, whereby said DC potential is coupled to said wire and said ultrasonic signal is impressed thereon for coupling to said transmitting means and said multiplier; and power supply means connected to said wire for developing a receiving means powering potential from said DC potential and said ultrasonic signal impressed thereon.

6. An ultrasonic intrusion alarm system for detecting a disturbance in an ultrasonic field comprising:

oscillator means including a sweep oscillator for generating a sweep signal and a main oscillator driven by said sweep oscillator and operative to generate an ultrasonic signal, the frequency of which is swept at the frequency of said sweep signal;

transmitting means for receiving said ultrasonic signal and for generating an ultrasonic field commensurate therewith;

receiving means disposed proximate said transmitting means for receiving said ultrasonic signal, for receiving Doppler shifted energy reflected by a disturbance in the field and for generating a difference signal at the Doppler frequency of said reflected energy, said receiver means including transducer means for receiving said Doppler shifted energy and for generating a received signal, receiver amplifier means for developing an amplifier received signal, a multiplier for receiving said amplified received signal and said ultrasonic signal and for developing the product of said amplified received signal and said ultrasonic signal to generate said difference signal, said multiplier including a first resistor;

a second resistor;

a first transistor having an emitter coupled to a first source of potential, a base for receiving said amplified received signal, and a collector, whereby said first transistor develops at said first transistor collector a control current proportional to the instantaneous amplitude of said amplified received signal;

a second transistor having an emitter coupled to said collector of said first transistor, a base for receiving said ultrasonic signal, and a collector coupled to a second source of potential by said first resistor, and a third transistor having an emitter coupled to said collector of said first transistor, a base coupled to a third source of potential, and a collector coupled to said second source of potential by said second resistor, whereby a pair of differential signals are developed at said collectors of said second and third transistors which are proportionals to the product of said amplified received signal and said ultrasonic signal, said differential signals including said difference signal and a complementary signal;

field disturbance detector means for receiving said difference signal and for developing an annunciator driving signal when said difference signal exceeds a predetermined level, said field disturbance detector means including disturbance amplifier means for developing an amplified difference signal;

filter means for developing a filtered amplified difference signal; and detector means for receiving said filtered amplified difference signal and for developing said annunciator driving signal when said filtered amplified difference signal exceeds a predetermined level; and annunciator means responsive to said annunciator driving signal.

7. An ultrasonic intrusion alarm system as recited in claim 6 wherein said filter means includes:

a high pass filter for developing a partially filtered amplified difference signal; and a low pass filter for receiving said partially filtered amplified difference signal and for developing said filtered amplified difference signal containing those components of the amplified difference signal indicative of human intruder caused field disturbance.

8. An ultrasonic intrusion alarm system as recited in claim 6 wherein said disturbance amplifier means includes:

a third resistor;

a fourth resistor;

a first operational amplifier having a first inverting input coupled to said collector of said second transistor and an output coupled to said first inverting input by said third resistor, said first operational amplifier for developing a first amplified differential signal;

a second operational amplifier having a second inverting input coupled to said collector of said third transistor and an output coupled to said second inverting input by said fourth resistor, said second operational amplifier for developing a second amplifier differential signal; and a difference amplifier having a third inverting input for receiving said first amplified differential signal and a non-inverting input for receiving said second amplified differential signal, said difference amplifier for developing said amplified difference signal by subtracting said first and second amplified differential signals.

* * * * *